US006422930B2

(12) United States Patent
Hakomori

(10) Patent No.: US 6,422,930 B2
(45) Date of Patent: Jul. 23, 2002

(54) APPARATUS FOR REMOVING DEPOSITED FILM

(75) Inventor: Shunji Hakomori, Ayase (JP)

(73) Assignee: Speedfam Co., Ltd., Kanagawa (JP)

( * ) Notice: Subject to any disclaimer, the term of this patent is extended or adjusted under 35 U.S.C. 154(b) by 25 days.

(21) Appl. No.: 09/764,655

(22) Filed: Jan. 17, 2001

(30) Foreign Application Priority Data

Apr. 25, 2000 (JP) ..... 2000-124405

(51) Int. Cl.[7] ..... B24B 21/00

(52) U.S. Cl. ..... 451/325; 451/41; 451/43; 451/44; 451/57; 451/177; 451/179

(58) Field of Search ..... 451/41, 43, 44, 451/57, 177, 179

(56) References Cited

U.S. PATENT DOCUMENTS

| | | | | |
|---|---|---|---|---|
| 5,476,413 A | * | 12/1995 | Hasegawa et al. | 451/168 |
| 5,866,477 A | | 2/1999 | Ogawa et al. | |
| 6,159,081 A | * | 12/2000 | Hakomori | 451/57 |
| 6,261,160 B1 | * | 7/2001 | Hakomori | 451/66 |

FOREIGN PATENT DOCUMENTS

| | | |
|---|---|---|
| JP | 08-085051 | 4/1996 |
| JP | 09-186234 | 7/1997 |

* cited by examiner

*Primary Examiner*—Joseph J. Hail, III
*Assistant Examiner*—Shantese McDonald
(74) *Attorney, Agent, or Firm*—Ohlandt, Greeley, Ruggiero & Perle, L.L.P.

(57) ABSTRACT

An edge face of a deposited film at an edge portion of a device wafer having the deposited film formed on a substrate is polished at a substantially right angle so as to prevent the deposited film from peeling-off and dusting. A forming body having a sectional shape substantially agreeing with that of an edge portion of a device wafer after polishing, which is an object to be polished, is rotated and brought into contact with a polishing body so as to form a polishing portion on the polishing body surface. The edge portion of the object-to be polished is rotated and urged into contact with the formed polishing portion, so that the edge portion of the object to be polished is polished in a sectional shape agreeing with that of the polishing portion of the polishing body. The edge face of the deposited film on the substrate surface is polished not slantingly but at a right angel so as to be removed, so that peeling-off of the deposited film due to a post-process, etc., which will generate a foreign substance, can be prevented.

4 Claims, 5 Drawing Sheets

APPARATUS FOR REMOVING DEPOSITED FILM

BACKGROUND OF THE INVENTION

1. Field of the Invention

The present invention relates to an apparatus for removing a deposited film at an edge portion of an object to be polished, and in particular relates to an apparatus for removing a deposited film at an edge portion of a device wafer having a circuit formed on the top surface thereof.

2. Description of the Related Art

A semiconductor wafer used as a substrate of a semiconductor device, for example, having no circuit formed thereon is called a bare wafer and is produced from a sliced ingot of a single crystal of silicon, etc., via processes such as chamfering, lapping, etching, annealing, and polishing.

The bare wafer is generally polished by a material manufacturer and there are various known polishing means disclosed in Japanese Unexamined Patent Application Publication No. 7-193030 and Japanese Unexamined Patent Application Publication No. 8-85051, for example.

On the other hand, a semiconductor wafer having a circuit formed thereon is called a device wafer and as means for removing an unnecessary deposited film by polishing it, such techniques disclosed as in Japanese Unexamined Patent Application Publication No. 10-312981 and Japanese Unexamined Patent Application Publication No. 2000-068273 are known.

In Japanese Unexamined Patent Application Publication No. 10-312981, it is shown that an excess metal film adhering to the outer circumferential fringe of a device wafer is polished and removed,by etching or making contact with a polishing pad. In Japanese Unexamined Patent Application Publication No. 2000-068273, it is disclosed that a film remaining in a portion having no pattern formed thereon in the outer circumferential fringe of a device wafer (a wafer edge portion) is removed by mechanically polishing it using a polishing pad rotated to be made contact with it.

However, in any one of the cases disclosed in the above-mentioned publications, a deposited film is removed along an extension line of a slope or a deposited film on a flat plane linking with a slope cannot be removed, so that the deposited film on the flat plane is prone to be peeled off during the transferring of the device wafer due to the contact with a chuck, for example, which may have a bad influence upon a post-process.

Furthermore, apparatuses capable of simultaneously removing a deposited film on the entire outer circumferential fringe, i.e., an end face, a slope, and a flat plane linking with the slope by a single polishing are demanded.

SUMMARY OF THE INVENTION

The present invention aims at solving the above-described conventional problems and further at responding to the demand, wherein deposited films on an end face, a slope, and a flat plane linking with the slope of the outer circumferential fringe of a device wafer can be simultaneously removed by a single polishing while peeling off due to a post-process, etc., which will generate a foreign substance, can be securely prevented by removing a deposited film on the flat plane. in an orthogonal direction thereto. Thereby, it is an object of the present invention to provide an apparatus for removing a deposited film being capable of completely suppressing a bad influence due to dusting and the like upon a post-process.

In order to achieve the above-described object, in accordance with the present invention, there is provided an apparatus for removing a deposited film in an edge portion of a substrate to be polished, the apparatus for removing the deposited film comprising: a polishing body having at least one polishing portion formed thereon and having substantially the same shape as that of the edge portion of the substrate; a forming body for forming the polishing portion having substantially the same shape as that of the edge portion of the substrate on the polishing body; a holding member for a forming body; a holding member for a polishing body; and a holding member for an object to be polished having mechanisms for rotation, horizontal movement, and pressing, wherein the forming body movably held by the holding member for a forming body is brought into contact with the polishing body held rotatably and vertically movably by the holding member for a polishing body so as to form the polishing portion, and wherein the substrate held by the holding member is urged into contact with the polishing body so as to remove a deposited film at the edge portion by polishing.

The polishing portion of the polishing body may be formed so as to substantially agree with an edge face, a slope, and a flat plane of the substrate to be polished. Preferably, the holding member for a forming body rotatably holding the forming body is capable of relatively approaching to and separating from the direction of the holding member for a polishing body while making an edge portion of the forming body in contact with the surface of the polishing body during the approaching. Further, the object to be polished may comprise the substrate and a deposited film formed on the surface of the substrate.

By adopting the means as described above in the present invention, an edge portion that is the external periphery of the device wafer is positioned at the polishing portion of the polishing body, so that deposited films on an edge face, a slope, and a flat plane linking to the slope of the edge portion can be simultaneously removed.

Even when the polishing portion wears down due to polishing, the most suitable shape can be maintained by correcting the polishing portion of the polishing body with the forming body. Then, the external periphery of the device wafer to be polished is positioned at the polishing portion and is relatively urged into contact with the polishing portion and rotating the device wafer, so that the edge portion of the device wafer can be polished in a sectional shape agreeing with that of the polishing portion of the polishing body, thereby simultaneously polishing the edge face, the slope, and the flat plane linking to the slope.

DESCRIPTION OF THE PREFERRED EMBODIMENTS

Figure 1:
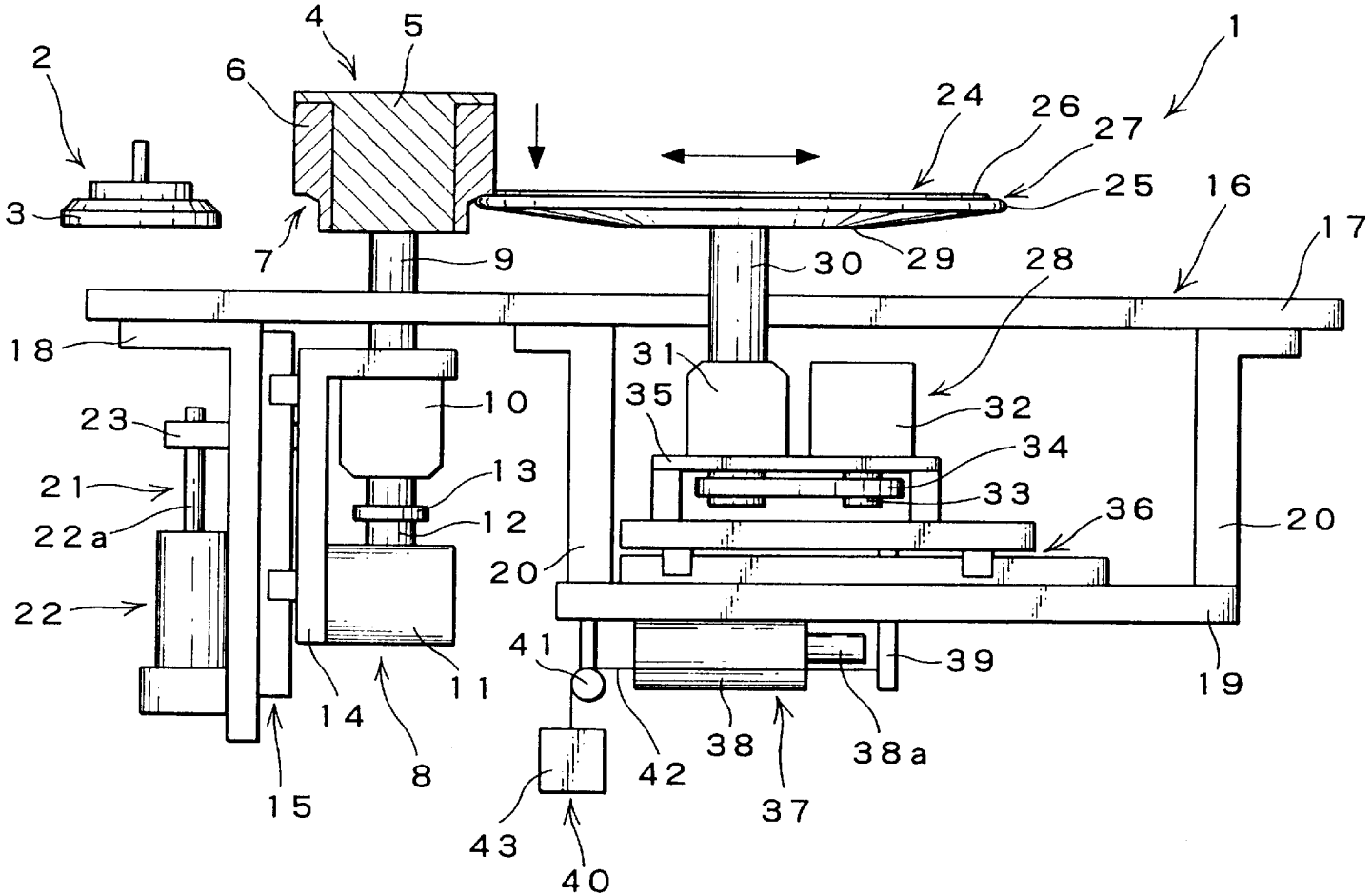
FIG. 1 is a schematic explanatory view of a polishing apparatus according to an embodiment of the present invention showing a completed state of polishing.

An embodiment of the present invention shown in the drawings will be described below.

Figure 2:
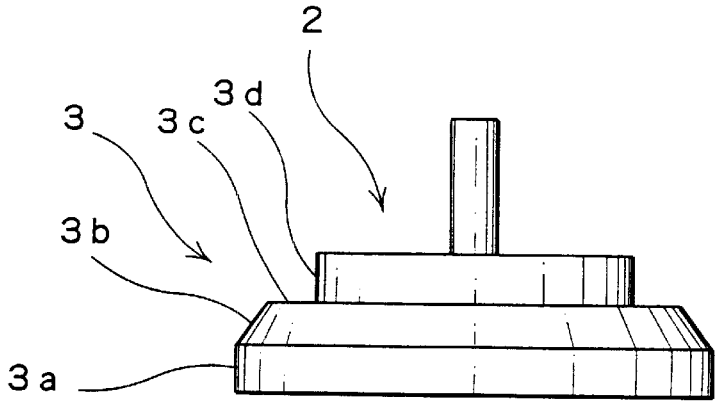
FIG. 2 is an enlarged view of a forming body shown in FIG. 1.
Figure 3:
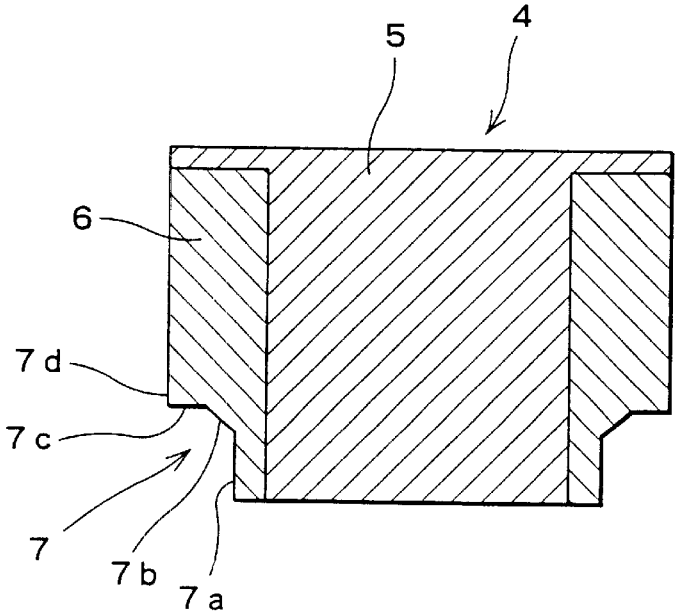
FIG. 3 is an enlarged sectional view of a polishing body shown in FIG. 1.

FIGS. 1 to 3 show a polishing apparatus according to an embodiment of the present invention. A polishing apparatus 1 comprises a forming body 2 having an edge portion 3 thereof formed to agree in a sectional shape with an edge portion 27 of an object to be polished 24 after polishing, a holding member for a forming body (not shown) rotatably holding the forming body 2 and being movable in the horizontal direction, a polishing body 4 having a polishing portion 7 thereof formed to agree in a sectional shape with the edge portion 3 of the forming body 2 in the periphery, a holding member for a polishing body 8 rotatably holding the polishing body 4 and being movable in the vertical direction, a holding member for an object to be polished 28 rotatably holding the object to be polished 24 and being movable in the horizontal direction, and a pressuring member 40 for pressuring the holding member for an object to be polished 28 in the direction of the holding member for a polishing body 8.

The above-mentioned forming body 2 is plate-shaped and made of a molded grindstone and the like, and the edge portion 3 thereof is formed to agree in a sectional shape with the edge portion 27 of the object to be polished 24 after polishing.

The edge portion 3 of the forming body 2 is formed of an edge-face-forming portion 3*a* corresponding to a periphery of a substrate 25, which will be described later, of the object to be polished 24, an slope-forming portion 3*b* corresponding to a chamfering portion of the substrate 25, a deposited-film-surface-forming portion 3*c* corresponding to an end of a deposited film 26 located in the top-face side of the edge portion 27 of the substrate 25, and a deposited-film-edge-face-forming portion 3*d* corresponding to an edge face of the deposited film 26 (see FIG. 2).

The forming body 2 rotatably held by a holding member for a forming body 50 moves in the horizontal direction during the movement of the holding member for a forming body 50, so that the edge portion 3 makes contact with the periphery of the polishing body held by the holding member for a polishing body 8, which will be described later.

Figure 5:
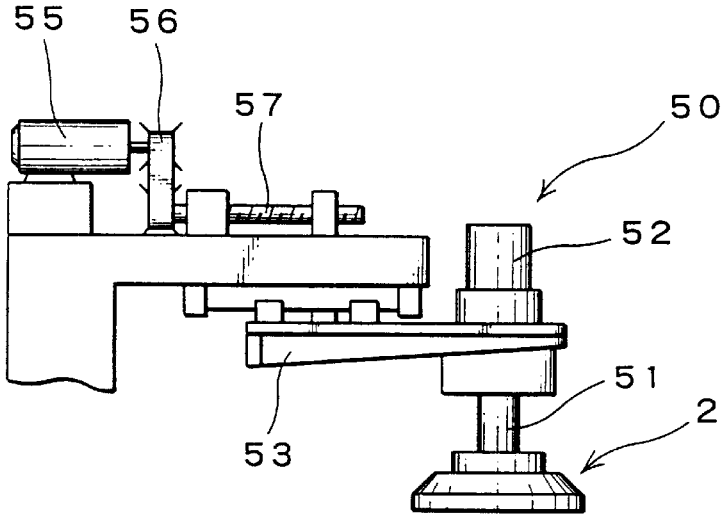
FIG. 5 is a schematic illustration of a holding member for a forming body.

As shown in FIG. 5, in the holding member for a forming body 50, a base 53 holding a driving source 52 for rotationally driving a shaft 51 holding the forming body 2 is movable in the horizontal direction by a ball screw 57 being rotatable by a stepping motor 55, which is a driving source and disposed on the top of a base 54, via a belt 56.

In addition, the transferring means may be a cylinder or a combination of a cylinder and a weight instead of the ball screw 57.

The above-mentioned polishing body 4 is formed of a column-shaped core member 5 and a cylindrical polishing pad 6 unitarily attached on the surface of the core member 5 by means such as adhesion, and on the entire peripheral face of the polishing pad 6 formed is the polishing portion 7 having a sectional shape agreeing with that of the edge portion 3 of the forming body 2.

The polishing portion 7 on the periphery of the polishing pad 6 is formed of an edge-face-polishing portion 7*a* corresponding to the edge-face-forming portion 3*a* of the edge portion 3 of the forming body 2, a slope-polishing portion 7*b* corresponding to the slope-forming portion 3*b*, a deposited-film-surface-polishing portion 7*c* corresponding to the deposited-film-surface-forming portion 3*c*, and a deposited-film-edge-face-polishing portion 7*d* corresponding to the deposited-film-edge-face-forming portion 3*d* (see FIG. 3).

Figure 6:
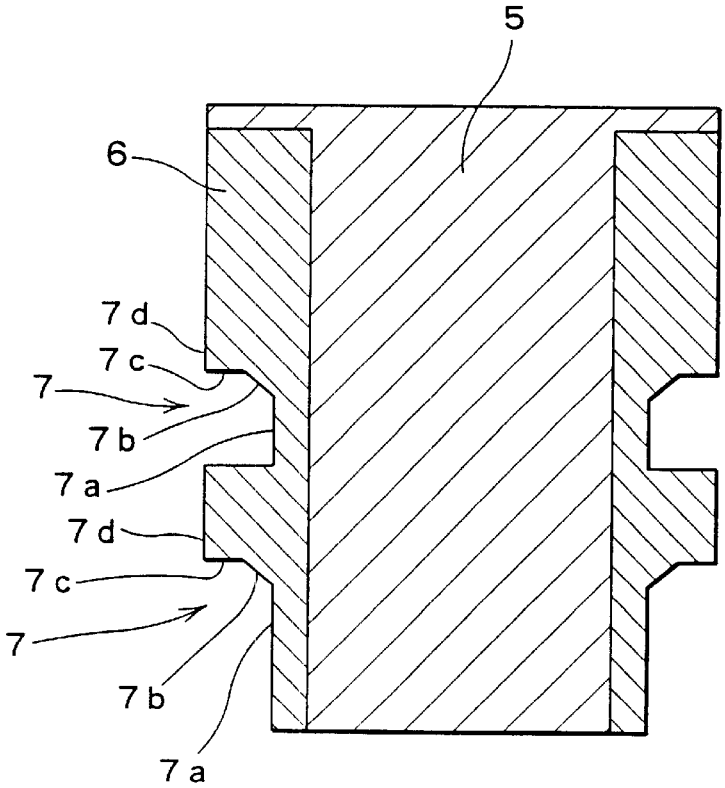
FIG. 6 is an enlarged sectional view of another example of a polishing body.

In the embodiment, one polishing portion 7 is formed on the periphery of the polishing pad 6; however, as shown in FIG. 6, two polishing portions 7 and 7 may be formed or although not shown in the drawing, three or more polishing portions 7, . . . may be formed. In such a manner, by forming plural polishing portions 7, . . . on the periphery of the polishing pad 6, even when one polishing portion 7 cannot be used due to hanging by use, another polishing portion 7 can be used instead, thereby eliminating the replacing work to a new polishing body 4, so that production efficiency can be extremely improved.

The above-mentioned holding member for a polishing body 8 is formed of a rotating shaft 9 with its upper end portion unitarily connected to the lower end portion of the core member 5 of the polishing body 4, a bearing case 10 for rotatably supporting the rotating shaft 9, a driving source 11 for rotationally driving the rotating shaft 9, and driving force transmitting means 13 such as pulleys and a belt for connecting between a driving shaft 12 of the driving source 11 and the lower end portion of the rotating shaft 9.

The bearing case 10 and the driving source 11 of the holding member for a polishing body 8 are unitarily attached to a base 14 while the base 14 is attached to a base frame 16 via a guide 15 movably in the vertical direction. Therefore, the holding member for a polishing body 8 is movable in the vertical direction along the guide 15 together with the base 14.

The above-mentioned base frame 16 is formed of an upper plate 17, a supporting plate 18 unitarily connected to the left end of the upper plate 17 in the bottom surface side, a lower plate 19 disposed in the lower side of the upper plate 17 and opposing the upper plate 17, and a pair of connecting plates 20 and 20 for unitarily connecting between the upper plate 17 and the lower plate 19, and on the supporting plate 18, the base 14 and the holding member for a polishing body 8 are attached movably in the vertical direction along the guide 15.

A transferring member 21 is attached to the supporting plate 18, and the holding member for a polishing body 8 is to be moved in the vertical direction during the operation of the transferring member 21. The transferring member 21 is constructed from a cylinder 22 such as a servo-cylinder and a connecting plate 23 for connecting between a rod 22*a* of the cylinder 22 and the base 14. When the rod 22*a* is extended by actuating the cylinder 22, the base 14 and the holding member for a polishing body 8 ascend in the vertical direction via the connecting plate 23 while the rod 22*a* is retracted, the base 14 and the holding member for a polishing body 8 descend in the vertical direction via the connecting plate 23.

The transferring member 21 serves as a pressuring member as well, that is, when the holding member for a polishing body 8 is lowered by actuating the cylinder 22, the polishing body 4 can be urged into contact with the object to be polished 24 from above.

Although not shown in the drawing, the holding member for an object to be polished 28 may be constructed to be upwardly moved while the holding member for a polishing body 8 is fixed, and both the holding member for an object to be polished 28 and the holding member for a polishing body 8 may be movable in the vertical direction.

The object to be polished 24 is the disc-like substrate 25 formed of a semiconductor wafer, etc., having the deposited film 26 such as an insulating film formed on the top surface of the substrate 25, and a part of the deposited film 26 located on the top surface of the edge portion 27 is to be removed by polishing.

In addition, the substrate 25 is not limited to be circular disc-like; it may be a disk having an orientation flat which is a flat notch at a part of the peripheral face.

The holding member for an object to be polished 28 is formed of a retaining disc 29 for horizontally holding the object to be polished 24 by means such as vacuum sucking means, a rotational shaft 30 with the upper end thereof unitarily connected to the center of the bottom surface of the retaining disc 29, a bearing case 31 for rotatably supporting the rotational shaft 30, a driving source 32 for driving the rotational shaft 30, and a driving force transmitting means 34 comprising a belt and pulleys for connecting between a driving shaft 33 of the driving source 32 and the lower end portion of the rotational shaft 30.

The bearing case 31 and the driving source 32 of the holding member for an object to be polished 28 are attached to a base 35 which is arranged movably in the horizontal direction in the top face side of the lower plate 19 of the base frame 16 along a guide 36. Therefore, the holding member for an object to be polished 28 is movable in the horizontal direction along the guide 36 unitarily with the base 35.

In the bottom face side of the lower plate 19 of the base frame 16, a transferring member 37 is arranged, and the holding member for an object to be polished 28 is moved in the horizontal direction during the operation of the transferring member 37. The transferring member 37 comprises a cylinder 38 attached to the bottom face side of the lower plate 19 and a pushing plate 39 attached to the side of the base 35 of the holding member for an object to be polished 28. When the cylinder 38 is actuated, a rod 38a is extended in the horizontal direction so that the end thereof abuts the pushing plate 39, and thereby the holding member for an object to be polished 28 is urged so as to be moved in the separating direction from the holding member for a polishing body 8 via the pushing plate 39.

In addition, although not shown in the drawing, the holding member for an object to be polished 28 may be urged in the approaching direction toward the holding member for a polishing body 8 so as to be moved in this direction when the cylinder 38 is actuated.

Also, while the holding member for an object to be polished 28 is fixed, the holding member for a polishing body 8 may be movable in the horizontal direction, or both the holding member for an object to be polished 28 and the holding member for a polishing body 8 may be movable in the horizontal direction.

In the bottom face side of the lower plate 19, a pressing member 40 is arranged, and the holding member for an object to be polished 28 is urged by the pressing member 40 in the direction toward the holding member for a polishing body 8, so that the object to be polished 24 held by the holding member for an object to be polished 28 is urged into contact with the polishing body 4 held by the holding member for a polishing body 8 from the horizontal direction.

The pressing member 40 is formed of a pulley 41 rotatably arranged in the bottom face side of the lower plate 19, a rope 42 wound around the pulley 41 and connected to the pushing plate 39 at one end of the rope 42, and a weight 43 connected to the other end of the rope 42.

By applying a load due to the weight 43 to the object to be polished 24 via the rope 42, the pushing plate 39, the base 35, and the holding member for an object to be polished 28, the object to be polished 24 can be urged toward the polishing body 4. Also, by changing the size of the weight 43, the load urged toward the polishing body 4 can be changed.

Next, the effects of the apparatus described-above will be described.

First, the holding member for a forming body 50 is moved in the horizontal direction so that the edge portion 3 of the forming body 2 is made contact with the peripheral face of the polishing pad 6 of the polishing body 4 held by the holding member for a polishing body 8, while the holding member for a forming body 50 and the holding member for a polishing body 8 are rotationally driven so that the polishing portion 7 having a sectional shape agreeing with that of the edge portion 3 of the forming body 2 is formed on the peripheral face of the polishing pad 6.

Then, the holding member for a forming body 50 is moved in the horizontal direction so that the forming body 2 is separated from the polishing body 4, while the holding member for an object to be polished 28 holding the object to be polished 24 is moved in the horizontal direction so that the edge portion 27 of the object to be polished 24 is made contact with the polishing portion 7 of the polishing pad 6 of the polishing body 4 and the edge portion 27 of the object to be polished 24 is urged into contact with the polishing portion 7 of the polishing body 4 from the horizontal direction by applying the load due to the weight 43 of the pressuring member 40. Then, by actuating the cylinder 22 of the holding member for a polishing body 8, the polishing body 4 is lowered in the vertical direction so that the polishing portion 7 of the polishing body 4 is urged into contact with the edge portion 27 of the object to be polished 24.

By rotating the polishing body 4 and the object to be polished 24 in this state in the same direction or different directions with each other, the edge portion 27 of the object to be polished 24 is started to be polished. At this time, when the substrate 25 of the object to be polished 24 has an orientation flat on the edge face thereof, which is a flat notch at a part of the edge face thereof, the rotational speed of the object to be polished 24 is set to be low, about 1 rpm, for example.

Figure 4:
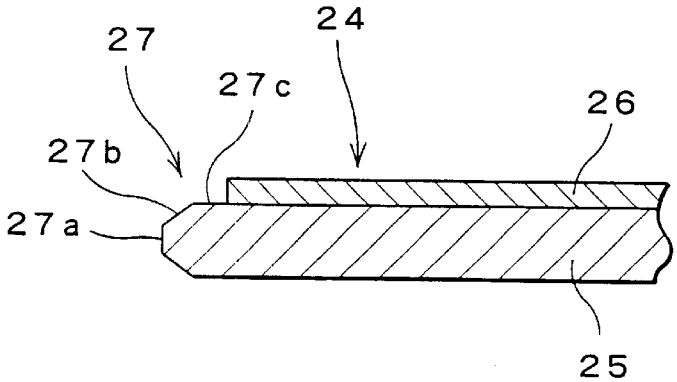
FIG. 4 is an enlarged fragmentary sectional view of an object to be polished after polishing.

After a predetermined time elapsed, the holding member for a polishing body 8 and the holding member for an object to be polished 28 are stopped; the holding member for a polishing body 8 is lifted by the operation of the cylinder 22; the holding member for an object to be polished 28 is moved by the operation of the cylinder 38 in the horizontal direction (the separating direction from the holding member for a polishing body 8). In such a manner, the edge portion 27 of the object to be polished 24 is polished in a sectional shape agreeing with that of the polishing portion 7 of the polishing body 4. This edge portion 27 of the object to be polished 24 is formed of an edge face 27*a*, a slope 27*b*, and a flat plane 27*c* linking with the slope 27*b* (see FIG. 4). In addition, by rotating the object to be polished 24 at a low rotational speed, the orientation flat portion can also be sufficiently polished.

Figure 10:
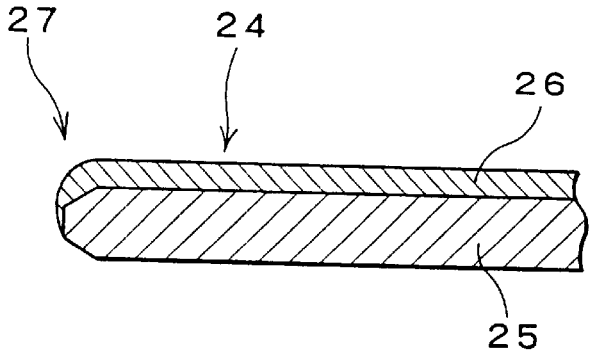
FIG. 10 is an enlarged fragmentary sectional view of a conventional object to be polished before polishing.
Figure 11:
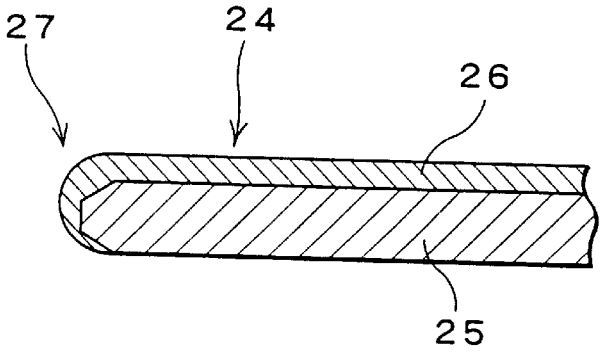
FIG. 11 is an enlarged fragmentary sectional view of a conventional object to be polished before polishing.
Figure 12:
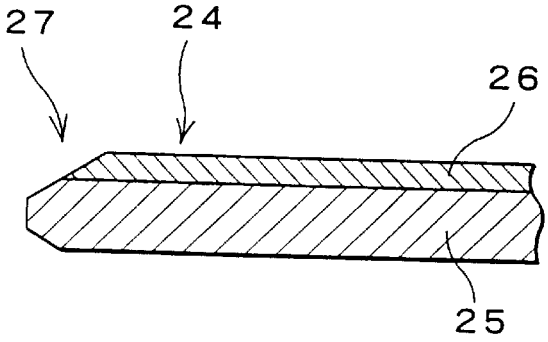
FIG. 12 is an enlarged fragmentary sectional view of a conventional object to be polished after polishing.

That is, as shown in FIGS. 10 and 11, in the edge portion 27 of the object to be polished 24 before polishing, the deposited film of the object to be polished 24 is formed to the edge face or extended to the bottom face to cover it across the edge face. By a conventional polishing apparatus, the deposited film 26 is diagonally polished so as to have an inclined sectional shape after polishing, as shown in FIG. 12, so that the deposited film 26 is prone to be peeled off the substrate 25 due to the inclined sectional shape, thereby originating a foreign substance due to a post-process, etc.

However, in the polishing apparatus 1 according to the embodiment formed as described above, the polishing portion 7 of the polishing pad 6 in the polishing body 4 is formed of the edge-face-polishing portion 7*a* corresponding to the edge face of the substrate 25 in the object to be polished 24, the slope-polishing portion 7*b* corresponding to the slope of the substrate 25, the deposited-film-surface-polishing portion 7*c* corresponding to the end portion of the deposited film 26 located in the top face side of the edge portion 27 of the substrate 25, and the deposited-film-edge-face-polishing portion 7*d* corresponding to the edge face of the deposited film 26. Therefore, by the deposited-film-surface-polishing portion 7*c* and other polishing portions 7*a*, 7*b*, and 7*d*, the edge face of the deposited film 26 can be polished so as to be mirror-finished via the edge face of the substrate 25, the slope of the substrate 25, and the flat plane of the substrate 25 of the object to be polished 24. Moreover, the edge face of the deposited film 26 is polished at a substantially right angle relative to the flat plane of the substrate 25.

Therefore, the portion of the deposited film 26 positioned in the top face side of the edge portion 27 on the substrate 25 in the object to be polished 24 is polished not in an inclined shape but at a right angle instead due to the flat plane, so that possibilities of dusting due to the peeling off are completely eliminated.

Also, when the end portion of the deposited film 26 positioned in the top face side of the edge portion 27 on the substrate 25 is removed, the substrate 25 cannot be damaged. Consequently, post-processes cannot have the bad effect, thereby sharply increasing the production efficiency.

Figure 7:
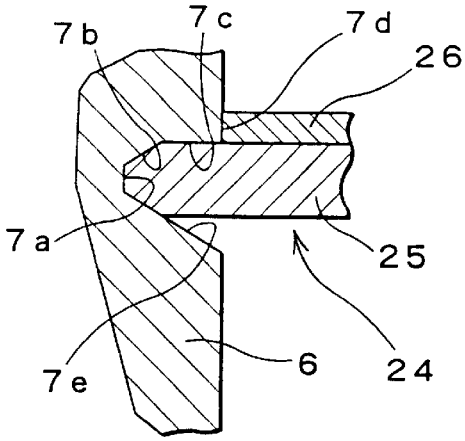
FIG. 7 is an enlarged sectional view of still another example of a polishing body.
Figure 8:
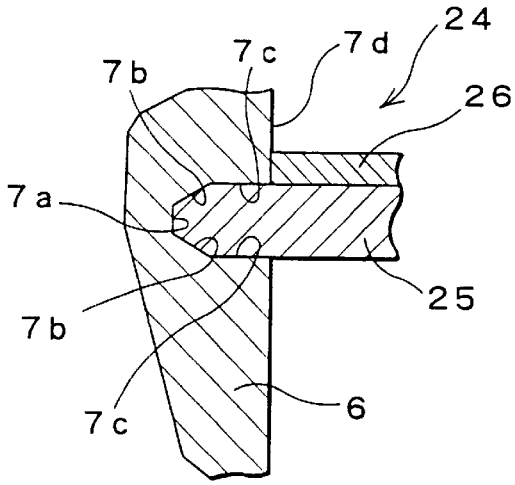
FIG. 8 is an enlarged sectional view of further another example of a polishing body.

Furthermore, as the polishing pad 6, structures shown in FIGS. 7 and 8 may be adopted. The structure shown FIG. 7 comprises the edge-face-polishing portion 7*a*, the slope-polishing portion 7*b*, the deposited-film-surface-polishing portion 7*c*, the deposited-film-edge-face-polishing portion 7*d*, and further a slope-polishing portion 7*e* extending from the edge-face-polishing portion 7*a* to the deposited-film-edge-face-polishing portion 7*d*.

The structure shown in FIG. 8 comprises the slope-polishing portion 7*b* and the deposited-film-surface-polishing portion 7*c* in each of upper and lower portions.

By using the polishing pad 6 having the structures described above, the polishing can be securely performed; however, there is a case that the polishing pad 6 can be no longer used due to gradual widening of the width in the vertical direction with use.

Figure 9:
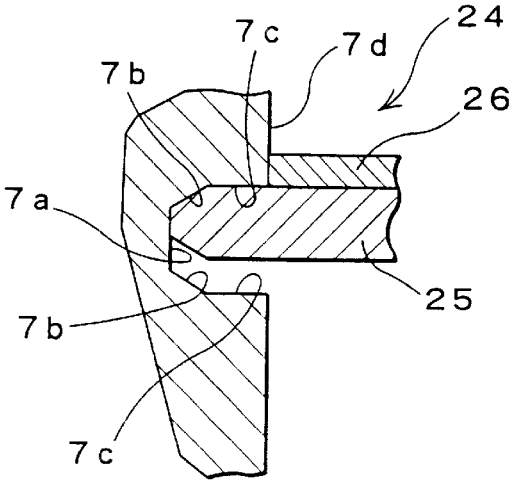
FIG. 9 is an enlarged sectional view of further another example of a polishing body.

In order to eliminate such a case, a polishing pad 6 shown in FIG. 9 is effective. That is, FIG. 9 shows the polishing pad 6 capable of two-step polishing in the vertical direction. This polishing pad 6 comprises the deposited-film-edge-face-polishing portion 7*d*, the deposited-film-surface-polishing portion 7*c*, the slope-polishing portion 7*b*, and the edge-face-polishing portion 7*a*, and in particular comprises the deposited-film-surface-polishing portion 7*c* and the slope-polishing portion 7*b* in each of upper and lower portions in a widened state of the width larger than the thickness of the object to be polished 24.

By such a structure, even when the width in the vertical direction is gradually widened with use, the object to be polished 24 can be securely polished.

In addition, when any one of the polishing pads described above is used, by polishing the deposited film 26 at a substantially right angle, on an object to be polished after polishing, a flat plane, which is not formed on a conventional object to be polished, is to be formed.

In addition, in the embodiment, the forming body 2 and the holding member for a forming body 50 are constituent elements of the polishing apparatus 1; however, the forming body 2 and the holding member for a forming body 50 may be different members from the polishing apparatus 1; before the polishing of the object to be polished 24 by the polishing apparatus 1, a polishing portion 7 is formed on the surface of the polishing body 4 by a different forming body 2 and a holding member for a forming body 50 in advance, so that the polishing body 4 having this polishing portion 7 formed thereon may be held by the holding member for a polishing body 8.

Also, in the embodiment, when the polishing portion 7 is formed on the polishing body 4 by the forming body 2, both the holding member for a forming body 50 and the holding member for a polishing body 8 are rotationally driven; however, only the polishing body may be rotated.

Furthermore, when the edge portion 27 of the object to be polished 24 is polished by the polishing portion 7 of the polishing body 4, both the holding member for a polishing body 8 and the holding member for an object to be polished 28 are rotationally driven; however, only the object to be polished may be rotated.

In addition, in the embodiment described above, the most preferable example is that all of the forming body, the polishing body, and the object to be polished are rotated. During the forming, the forming body of the forming body and the polishing body may be stopped; further, during the polishing, the polishing body of the polishing body and the object to be polished may be stopped.

What is claimed is:

1. An apparatus for removing a deposited film in an edge portion of a substrate to be polished, the apparatus for removing the deposited film comprising:

a polishing body having at least one polishing portion formed thereon and having substantially the same shape as that of the edge portion of the substrate;

a forming body for forming the polishing portion having substantially the same shape as that of the edge portion of the substrate on the polishing body;

a holding member for a forming body;

a holding member for a polishing body; and a holding member for an object to be polished having mechanisms for rotation, horizontal movement, and pressing, wherein the forming body movably held by the holding member for a forming body is brought into contact with the polishing body held rotatably and vertically movably by the holding member for a polishing body so as to form the polishing portion, and wherein the substrate held by the holding member is urged into contact with the polishing body so as to remove a deposited film at the edge portion by polishing.

2. An apparatus according to claim 1, wherein the polishing portion of the polishing body is formed so as to substantially agree with an edge face, a slope, and a flat plane of the substrate to be polished.

3. An apparatus according to claim 1, wherein the holding member for a forming body rotatably holding the forming body is capable of relatively approaching to and separating from the direction of the holding member for a polishing body while making an edge portion of the forming body in contact with the surface of the polishing body during the approaching.

4. An apparatus according to claim 1, wherein the object to be polished comprises the substrate and a deposited film formed on the surface of the substrate.

* * * * *